United States Patent [19]

Parker et al.

[11] Patent Number: 4,817,304

[45] Date of Patent: Apr. 4, 1989

[54] FOOTWEAR WITH ADJUSTABLE VISCOELASTIC UNIT

[75] Inventors: Mark G. Parker, Beaverton, Oreg.; David M. Forland, Vancouver, Wash.; Lester Q. Lee, Gaston, Oreg.; Thomas McGuirk, Lake Oswego, Oreg.; Daniel R. Potter; Stephen F. Potter, both of Beaverton, Oreg.

[73] Assignee: Nike, Inc. and Nike International Ltd., Beaverton, Oreg.

[21] Appl. No.: 90,926

[22] Filed: Aug. 31, 1987

[51] Int. Cl.[4] ..... A43B 13/12; A43B 13/18; A43B 13/20

[52] U.S. Cl. ..... 36/114; 36/28; 36/30 R; 36/29

[58] Field of Search ..... 36/28, 29, 3 R, 3 B, 36/30 R, 32 R, 27, 35 B, 114

[56] References Cited

U.S. PATENT DOCUMENTS

| | | | |
|---|---|---|---|
| D. 129,487 | 9/1941 | Kardo-Sessoeff | D2/319 |
| D. 241,586 | 9/1976 | Sebestik | D2/4 |
| D. 256,066 | 7/1980 | Hagg et al. | D2/322 |
| D. 256,067 | 7/1980 | Hagg et al. | D2/322 |
| D. 260,196 | 8/1981 | Plagenhoef | D2/319 |
| D. 261,946 | 11/1981 | Trask | D2/322 |
| D. 263,348 | 3/1982 | Cohen | D2/322 |
| D. 263,518 | 3/1982 | Cohen | D2/322 |
| D. 265,017 | 6/1982 | Vermonet | D2/4 |
| D. 265,019 | 6/1982 | Vermonet | D2/320 |
| D. 289,341 | 4/1987 | Turner | D2/322 |
| 900,867 | 10/1908 | Miller | 36/28 |
| 1,069,001 | 7/1913 | Guy | 36/29 |
| 1,304,915 | 5/1919 | Spinney | 36/29 |
| 1,514,468 | 11/1924 | Schopf | 36/29 |
| 1,869,257 | 7/1932 | Hitzler | 36/29 |
| 2,080,469 | 5/1937 | Gilbert | 36/29 |
| 2,199,853 | 5/1940 | Joyce, Jr. | 36/28 |
| 2,527,414 | 10/1950 | Hallgren | 36/32 R |
| 2,547,480 | 4/1951 | McDaniel | 36/30 R |
| 2,645,865 | 7/1953 | Town | 36/71 |
| 2,677,906 | 5/1954 | Reed | 36/71 |
| 2,985,971 | 5/1961 | Murawski | 36/29 |
| 3,079,708 | 3/1963 | Hack et al. | 36/28 |
| 3,087,261 | 4/1963 | Russell | 36/28 |
| 3,087,262 | 4/1963 | Russell | 36/28 |

(List continued on next page.)

FOREIGN PATENT DOCUMENTS

| | | | |
|---|---|---|---|
| 0215974 | 4/1987 | European Pat. Off. | 36/29 |
| 352216 | 4/1922 | Fed. Rep. of Germany | 36/29 |
| 841035 | 5/1939 | France . | |
| 1461743 | 12/1950 | France . | |
| 1011213 | 6/1952 | France | 36/29 |
| 1018215 | 12/1952 | France . | |
| 535171 | 4/1941 | United Kingdom . | |
| 2032761 | 10/1979 | United Kingdom . | |

OTHER PUBLICATIONS

International Publication WO81/01234 Date: May 14, 1981, Clarks Shoe Photocopy.

U.S. Ser. No. 065,501, filed 6/23/87, (Design Application).

U.S. Ser. No. 065,500, filed 6/23/87, (Design Application).

*Primary Examiner*—Steven N. Meyers

*Attorney, Agent, or Firm*—Banner, Birch, McKie & Beckett

[57] ABSTRACT

Footwear having an improved cushioning sole structure is disclosed. The footwear includes an upper and a sole member attached to the upper. The sole member includes a sealed inner member of a flexible material which is inflated with a gaseous medium to form a compliant and resilient insert. An elastomeric yieldable outer member encapsulates the insert about preselected portions of the insert. The inner and outer members function together to form a viscoelastic unit for attenuating the shock and returning the energy of foot impact. A mechanism adjusts the impact response of the unit so that the effect of the insert dominates the impact response function in a predetermined area adjacent at least one side of the insert. The adjusting mechanism includes a gap in the outer member along the side of the insert adjacent the predetermined area so that the flexible material of the sealed inner member can flex in the gap during foot impact.

26 Claims, 2 Drawing Sheets

U.S. PATENT DOCUMENTS

| | | | |
|---|---|---|---|
| 3,120,712 | 2/1964 | Menken | 36/29 |
| 3,160,963 | 12/1964 | Aaskov | 36/11.5 |
| 3,253,355 | 5/1966 | Menken | 36/29 |
| 3,469,576 | 9/1969 | Smith et al. | 128/595 |
| 4,129,951 | 12/1978 | Petrosky | 36/29 |
| 4,183,156 | 1/1980 | Rudy | 36/44 |
| 4,219,945 | 9/1980 | Rudy | 36/29 |
| 4,223,457 | 9/1980 | Borgeaz | 36/35 B |
| 4,235,026 | 11/1980 | Plagenhoef | 36/32 R |
| 4,236,326 | 12/1980 | Inohara | 36/29 |
| 4,262,433 | 4/1981 | Hagg et al. | 36/25 R |
| 4,271,606 | 6/1981 | Rudy | 36/29 |
| 4,322,892 | 4/1982 | Inohara | 36/29 |
| 4,340,626 | 7/1982 | Rudy | 428/35 |
| 4,359,830 | 11/1982 | Inohara | 36/29 |
| 4,391,048 | 7/1983 | Lutz | 36/28 |
| 4,430,810 | 2/1984 | Bente | 36/32 R |
| 4,438,573 | 3/1984 | McBarron | 36/3 B |
| 4,445,284 | 5/1984 | Sakutori | 36/3 B |
| 4,472,890 | 9/1984 | Gilbert | 36/28 |
| 4,486,964 | 12/1984 | Rudy | 36/28 |
| 4,523,393 | 6/1985 | Inohara | 36/29 |
| 4,573,279 | 3/1986 | Feurer-Zogel et al. | 36/35 R |
| 4,610,099 | 9/1986 | Signori | 36/28 |
| 4,624,061 | 11/1986 | Wezer et al. | 36/32 R |
| 4,638,577 | 1/1987 | Riggs | 36/114 |
| 4,717,407 | 11/1983 | Fukuoka | 36/29 |
| 4,722,131 | 2/1988 | Huang | 29/450 |

FOOTWEAR WITH ADJUSTABLE VISCOELASTIC UNIT

TECHNICAL FIELD

The invention relates to footwear wherein a viscoelastic unit is provided in the sole member. The viscoelastic unit is comprised of a resilient gas inflated insert encapsulated within a shock absorbing foam material. The impact response characteristics of the unit are adjusted by placing one or more gaps in the foam material at predetermined locations adjacent the side of the insert.

BACKGROUND OF THE INVENTION

The modern shoe, particularly an athletic shoe, is a combination of many elements which have specific functions, all of which must work together for the support and protection of the foot. The design of an athletic shoe has become a highly refined science. Athletic shoes today are as varied in design and purpose as are the rules for the sports in which the shoes are worn. Tennis shoes, racquetball shoes, basketball shoes, running shoes, baseball shoes, football shoes, weightlifting shoes, walking shoes etc., are all designed to be used in very specific, and very different, ways. They are also designed to provide a unique and specific combination of traction, support, and protection to enhance performance. Not only are shoes designed for specific sports, they are also designed to meet the specific characteristics of the user. For example, shoes are designed differently for heavier persons than for lighter persons; differently for wide feet than for narrow feet; differently for high arches than for low arches, etc. Some shoes are designed to correct physical problems, such as overpronation, while others include devices, such as ankle supports, to prevent physical problems from developing. It is therefore important to be able to adjust the characteristics of the various functional components of the shoe to accommodate these factors.

A shoe is divided into two general parts, an upper and a sole. The upper is designed to snugly and comfortable enclose the foot. The other major portion of a shoe is the sole. The sole must provide traction, protection, and a durable wear surface. The considerable forces generated by running require that the sole of a running shoe provide enhanced protection and shock absorption for the foot and leg. It is also desirable to have enhanced protection and shock absorption for the foot and leg in all types of footwear. Accordingly, the sole of a running shoe typically includes several layers, including a resilient, shock absorbent material as a midsole and a ground contacting outer sole or outsole, which provides both durability and traction. This is particularly true for training or jogging shoes designed to be used over long distances and over a long period of time. The sole also provides a broad, stable base to support the foot during ground contact.

The typical midsole uses one or more materials or components which affect the force of impact in two important ways, i.e. through shock absorption and energy absorption. Shock absorption involves the attenuation of harmful impact forces. A midsole with high shock absorbing characteristics thus can provide enhanced foot protection, assuming other factors such as stability are not comprised. Energy absorption is simply the general soaking up of both impact and useful propulsive forces. Thus, a midsole with high energy absorbing characteristics has relatively lower resiliency, and generally does not return much of the energy placed into a midsole at foot impact. This results in less efficiency in foot motion and a "flat" feel. Conversely, a midsole with low energy absorbing characteristics has relatively higher resiliency, and generally returns more of the energy placed into a midsole at foot impact. The terms energy absorbing and shock absorbing have been used in the past without precise delineation between these effects, i.e., at times referring to one or the other of these effects and at other times referring to the combination of these effects. Since both of these effects relate to independent actions of a midsole operating on the forces of foot impact, the term impact response will be used herein to describe the combination of these effects; and the term viscoelastic will be used as a convenient way of ascribing the accomplishment of these two effects by a midsole unit of the present invention. It is desirable to design a midsole with proper impact response wherein both adequate shock absorption and resiliency are taken into account.

One type of sole structure wherein attempts have been made to design appropriate impact response into sole structures has been with soles or inserts for soles designed to contain fluid, either liquid or gas. Gas filled structures are shown for example in U.S. Pat. Nos. 900,867; 1,069,001; 1,304,915; 1,514,468; 1,869,257; 2,080,469; 2,645,865; 2,677,906; and 3,469,456.

However, none of the prior art fluid-filled sole structures met with any commercial success or substantial use until the development of the sole structure as disclosed in U.S. Pat. Nos. 4,183,156 and 4,219,945 of Marion F. Rudy. Earlier attempts at producing gas-filled sole structures failed to overcome numerous developmental problems such as providing adequate support and comfort. However, the most serious problem which early designs were unable to overcome was unreliability due to the inability to maintain the fluid pressure within the sole structures over an extended period of time. Deflation would occur because the fluid in the sole structures would diffuse through the barrier material of which the sole structures were constructed.

The sole structure disclosed in the '156 and '945 Rudy patents overcame the unreliability obstacle through the use of a novel membrane and gas combination. The sole structure in the '156 and '945 patents forms an inflatable insert or insole barrier member of an elastomer material having a multiplicity of preferably intercommunicating, fluid-containing chambers inflated to a relatively high pressure by a gas having a low diffusion rate through the barrier members, the gas being supplemented by ambient air diffusing through the barrier member into the chambers to increase the pressure therein, the pressure remaining at or above its initial value over a period of years. The inflatable insert is incorporated into the insole structure, in the '156 patent, by placement within a cavity below the upper, e.g. on top of a midsole layer and within sides of the upper or midsole layer. A ventilated moderator formed of a sheet of semi-flexible material is placed over the inflatable insert.

A different technique is used in the '945 patent for incorporating the inflatable insert into the shoe. In this patent, the inflatable insert is encapsulated within a yieldable foam material, which functions as a bridging moderator filling in irregularities of the insert, providing a substantially smooth and contoured surface for supporting the foot and forming an easily handled structure for attachment to an upper. When the inflatable insert is used in combination with an encapsulating foam, the impact response characteristics of the sole structure formed by the combination is determined or set by the combined effects of the two elements. Factors such as the relative volume of the two elements, the type of foam material used, and the pressure of the gas contained in the insert, varies the amount each element contributes to the impact response function of the sole structure.

The present invention was designed as an improvement in the sole structure which utilizes the combination of an inflatable insert within an encapsulating foam. The present invention provides a mechanism for adjusting the impact response characteristics of the overall structure to tailor the impact response to desired requirements. As was mentioned above, the capability of adjusting or tailoring the functioning of the components of a shoe is important to present day shoe design, particularly the design of athletic shoes.

SUMMARY OF THE INVENTION

The invention relates to an article of footwear which is comprised of an upper and a sole member attached to the upper. The sole member includes a sealed inner member of a flexible material which is inflated with a gaseous medium to form a compliant and resilient insert having spaced upper, lower and side surfaces. An elastomeric yieldable outer member encapsulates the insert about preselected portions of the insert including a major portion of at least the upper or lower surface and a portion of the side surfaces. The inner and outer members function together to form a viscoelastic unit for attenuating the shock, and returning the energy, of foot impact. A mechanism is provided for adjusting the impact response of the unit so that the effect of the insert dominates the impact response function of the unit in a predetermined area adjacent at least one side of the insert. The adjusting mechanism includes a gap in the outer member adjacent the side of the insert and the predetermined area so that the flexible material of the sealed inner member can flex in the gap during foot impact.

Improved compliance and resiliency result when the inflatable insert dominates the impact response characteristics of the unit. The absence of foam within the gap reduces the weight of the midsole, improves flexibility, and enhances the diffusion pumping process when the membrane/gas combination disclosed in the Rudy patents is used. Furthermore, by appropriately locating and shaping the gaps, the overall impact response characteristics along the length of the shoe can be fine tuned.

Various advantages and features of novelty which characterize the invention are pointed out with particularity in the claims annexed hereto and forming a part hereof. However, for a better understanding of the invention, its advantages, and objects obtained by its use, reference should be had to the drawings which form a further part hereof, and to the accompanying descriptive matter, in which there is illustrated and described preferred embodiments of the invention.

DETAILED DESCRIPTION OF THE INVENTION

Figure 2:
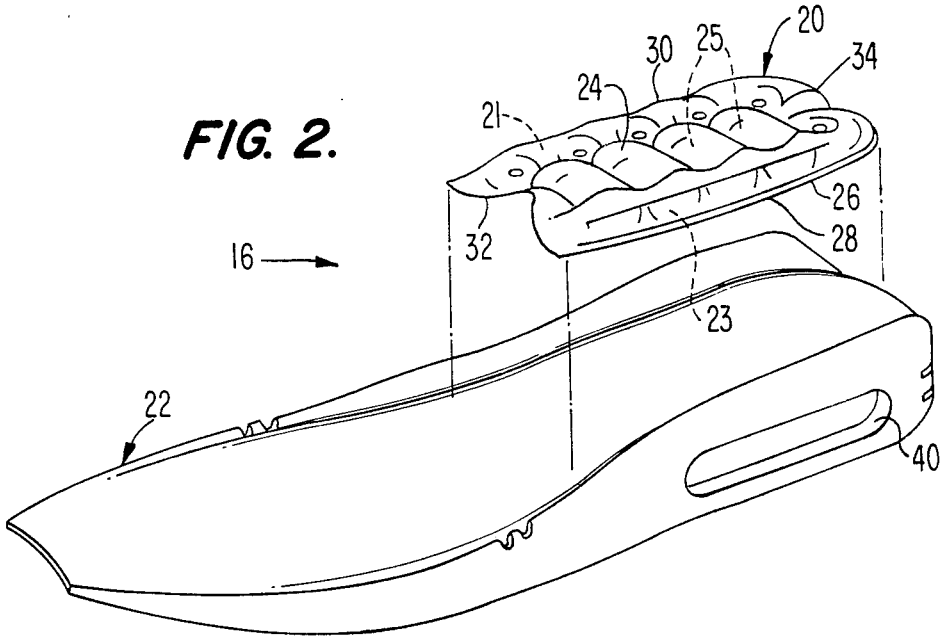
FIG. 2 is an exploded perspective view illustrating the inflatable insert removed from the encapsulating foam material.

Referring to the drawings, wherein like numerals indicate like elements, an article of footwear in accordance with the present invention, such as a running shoe, is generally shown as 10. Shoe 10 includes a sole structure or member 12 and an upper 14 attached to it. Upper 14 can be of any conventional design, while sole structure 12 incorporates novel features of the present invention. Sole structure 12 includes a force absorbing midsole 16 and a flexible, wear resistant outsole 18. Of course, where appropriate, the midsole and outsole portions can be formed as a single integral unit. Midsole 16 includes an inner member or insert 20 and an outer member 22. FIG. 2 illustrates insert 20 projected outside of outer member 22.

Insert 20 has a sealed perimeter and is inflated with a gaseous medium, thereby being compliant and resilient. Insert 20 has an upper surface 24, a lower surface 26, side surfaces 28, 30, a front surface 32 and a back surface 34, all spaced from one another when insert 20 is inflated. Upper surface 24 is connected to lower surface 26 at preselected points within the perimeter of insert 20, which when inflated with a gas takes on the configuration illustrated in FIG. 2 wherein a plurality of chambers are formed. The chambers include a longitudinally extending tube 21,23 adjacent each of the lateral and medial sides, with transverse tubes 25 connecting the longitudinal tubes.

In a preferred form of the invention, insert 20 is formed of a material as disclosed in the aforementioned Rudy patents and the gas is selected from the group of gases likewise mentioned in aforementioned Rudy patents, the disclosures of which are hereby incorporated by reference. That is, the material of the insert can be selected from the following materials: polyurethane; polyester elastomer; fluoroelastomer; chlorinated polyethylene; polyvinyl chloride; chlorosulfonated polyethylene; polyethylene/ethylene vinyl acetate copolymer; neoprene; butadiene acrylonitrile rubber, butadiene styrene rubber; ethylene propylene polymer; natural. rubber, high strength silicone rubber; low densite polyethylene; adduct rubber; sulfide rubber; methyl rubber; thermoplastic rubbers.

One of the above materials, which has been found to be particularly useful in manufacturing the inflated insert, is a polyurethane film.

Gases which have been found to be usable in pressure retention within the chambers are as follows: hexafluoroethane; sulfur hexafluoride; perfluoropropane; perfluorobutane; perfluoropentane; perfluorohexane; perfluoroheptane; octafluorocyclobutane; perfluorocyclobutane; hexafluoropropylene; tetrafluoromethane; monochloropentafluoroethane; 1, 2-dichlorotetrafluoroethane; 1,1,2trichloro-1,2,2 trifluoroethane; chlorotrifluoroethylene; bromotrifluoromethane; and monochlorotrifluoromethane. These gases may be termed supergases.

The two most desirable gases for use in the insert are hexafluoroethane and sulfur hexafluoride.

Insert 20 is located in the heel area of shoe 10 and is encapsulated within the foam material which forms outer member 22. The foam material preferably completely covers the upper and lower surfaces 24,26 of insert 20, as well as its entire front and rear surfaces 32, 34. However, as will be explained more fully hereinafter, the foam material of outer member 22 covers only a portion of side surfaces 28 and 30 leaving gaps in predetermined areas, one of which is shown as 40 in FIGS. 1 and 2. The foam material of outer member 22 can encapsulate insert 20 by any suitable method. For example, insert 20 can be held within a mold in and the foam material can thereafter be injected into the mold in a liquid state to mold and solidify around insert 20. Alternatively, outer member 22 can be first made, for example by molding, and thereafter insert 20 can be placed into a void within the formed outer member 22. The first technique has been found particularly suitable for use with the present invention.

As disclosed in the Rudy '945 patent, elastomeric foam materials from which the foam encapsulating member can be made include the following: polyether urethane; polyester urethane; ethylenevinylacetate/-polyethylene copolymer; polyester elastomer (Hytrel); ethylenevinylacetate/polypropylene copolymer; polyethylene; polypropylene; neoprene; natural rubber; dacron/polyester; polyvinylchloride; thermoplastic rubbers; nitrile rubber; butyl rubber; sulfide rubber; polyvinyl acetate; methyl rubber; buna N.; buna S.; polystyrene; ethylene propylene; polybutadiene; polypropylene; silicone rubber.

The most satisfactory of the above-identified elastic foam materials are the polyurethanes, ethylenevinylactate/ polyethylene copolymer; ethylene vinylacetate/-polypropylene copolymer, neoprene and polyester.

The foam encapsulating outer member 22 is permeable to air and essentially impermeable to the special gases, thus allowing the ambient air to pass therethrough and through the material of insert 20 into the chambers to enhance the fluid pressure therein, and preventing the fluid pressure from decreasing below a useful value, except after the passage of a substantial number of years.

In the area where insert 20 is located, the impact response characteristics of midsole 16, which functions as a viscoelastic unit for absorbing the shock of foot impact, is determined by the combined effects of both insert 20 and the encapsulating foam material of outer member 22. The impact response characteristics of midsole 16 include both the shock absorption and energy return functions discussed above. Gap 40 adjusts the impact response of midsole 16 in the predetermined area where it is located so that the impact response provided by midsole 16 is such that the effect of insert 20 dominates the impact response functions in this predetermined area because the flexible material of insert 20 is allowed to flex in gap 40 during foot impact. Thus, by appropriately locating gap 40 in a desired area, the impact response characteristic of midsole 16 can be adjusted from a combined effect of the encapsulating foam material and the gas inflated insert to one where the effect of the gas inflated insert dominates.

Figure 1:
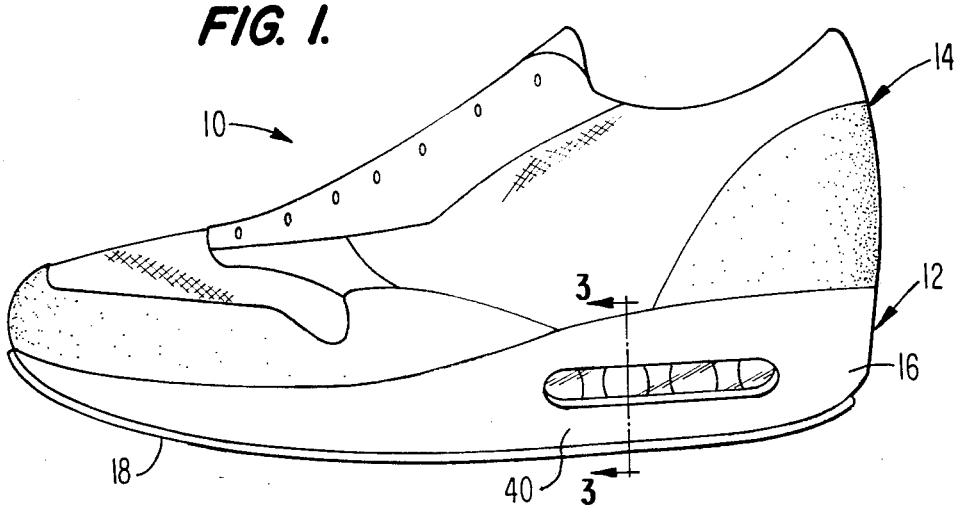
FIG. 1 is a side view of an athletic shoe embodying the invention.
Figure 3:
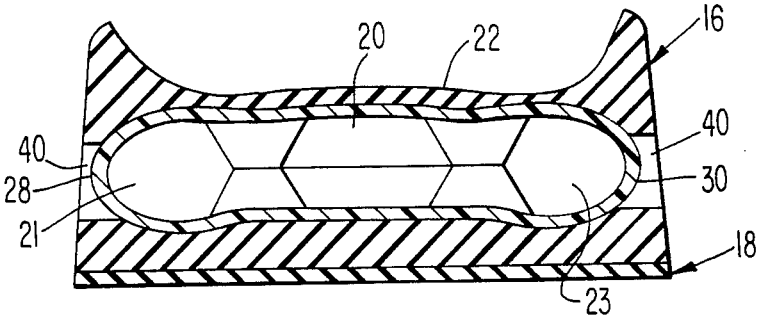
FIG. 3 is a cross-sectional view taken generally along line 3—3 of FIG. 1, with the upper being omitted.

In the embodiment illustrated in FIGS. 1, 2 and 3 the preselected areas are along the medial and lateral sides of the shoe in the heel area, and gap 40 is formed as an elongate gap in these areas. As best seen in FIG. 3, gap 40 extends from the outer edge of midsole 16 on both the medial and lateral sides and inwardly therefrom to side surfaces 28 and 30 of insert 20. If desired, of course, the gap could be located on only one side, such as the lateral side.

Figure 4:
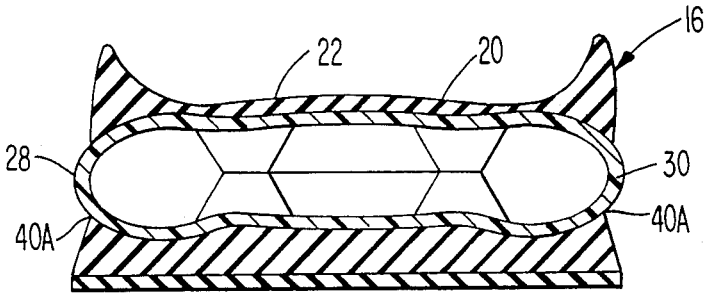
FIG. 4 is a cross-sectional view similar to FIG. 3, illustrating an alternate embodiment of a sole structure.

In FIG. 4, an alternate embodiment of insert 40 is illustrated where gaps 40A are formed in outer member 22 on both the medial and lateral sides. Gaps 40A are still located in predetermined areas adjacent sides 28 and 30 of insert 20 and extend to the outer edge of the midsole; however, the sides of outer member 22 are formed so that sides 28 and 30 of insert 20 are at least flush with, and preferably extend beyond, the sides of outer member 22. Gaps 40A function in the same manner as gaps 40 to adjust the impact response of midsole 16 by allowing the material of insert 20 to flex in the gaps.

Figure 5:
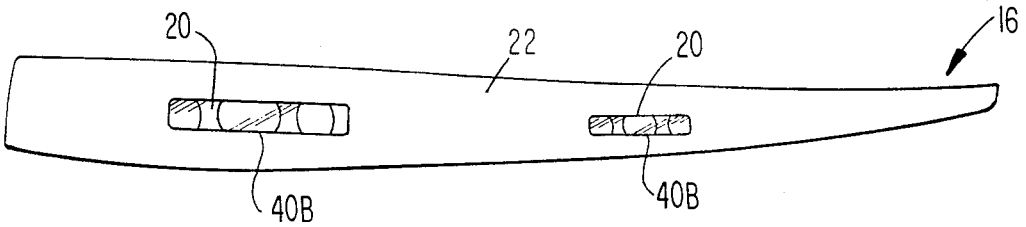
FIG. 5 is a side view of a further alternate embodiment of a sole structure in accordance with the present invention.

FIG. 5 illustrates an alternate embodiment wherein the predetermined area in which it is desired to have the gas inflated insert dominate the impact response effect of the sole structure includes both the heel and forefoot areas. Thus, gas inflated insert 20 is located in both the heel and forefoot areas and elongate gaps 40B in outer member 22 are located along the side surface of the inserts. Either one insert 20, which extends through both the heel and forefoot areas, or two separate inserts 20 can be used. If desired, the gaps can be located only in the forefoot area, or along only one side of the shoe. Placement of gaps 40B in the forefoot area adjusts the impact response in the forefoot area so that the viscoelastic properties of the insert dominate the impact response in that area.

All the embodiments are shown with the predetermined area having a forward end spaced rearward of the front surface of said insert and a rearward end spaced forward of the back surface of said insert whereby said impact response adjustment to said viscoelastic unit is substantially localized between the forward and rearward ends of said predetermined area.

Numerous characteristics, advantages, and embodiments of the invention had been described in detail in the foregoing description with reference to the accompanying drawings. However, the disclosure is illustrative only and the invention is not limited to the precise illustrated embodiments. Various changes and modifications may be effected therein by one skilled in the art without departing from the scope or spirit of the invention. For example, while the gaps in the preferred embodiments extend to the outside edge of the midsole, it should be understood that the gaps can be formed totally internal of the perimeter of the midsole. Such gaps need only perform the function of adjusting the impact response of the overall unit to allow the effect of the insert to dominate in the predetermined area.

We claim:

1. Footwear comprising an upper, a sole member attached to said upper, said sole member including a sealed inner member of flexible material, said inner member being inflated with a gaseous medium to form a compliant and resilient insert having spaced upper, lower, front, back and side surfaces, an elastomeric yieldable outer member encapsulating said insert about preselected portions of said insert, said preselected portions including a major portion of at least said upper or lower surface and a portion of said side surfaces, said inner and outer members functioning together to form a viscoelastic unit for attenuating shock and returning energy of foot impact,and means for adjusting the impact response of said viscoelastic unit to have the effect of said insert dominate the impact response function of said unit in a predetermined area adjacent at least one side of said insert, said adjusting means including a gap in said outer member along the side of said insert adjacent said predetermined area, said gap extending from a surface of said insert to form an open space where the flexible material of said sealed inner member can flex during foot impact, said predetermined area having a forward end spaced rearward of the front surface of said insert and a rearward end spaced forward of the back surface of said insert whereby said impact response adjustment to said viscoelastic unit is substantially localized between the forward and rearward ends of said predetermined area.

2. Footwear in accordance with claim 1 wherein the preselected portions of said insert encapsulated by said outer member include major portions of both said upper and lower surfaces.

3. Footwear in accordance with claim 1 or 2 wherein said predetermined area is located adjacent an outer edge of at least one side of said sole member and said gap extends to said outer edge of said at least one side of said sole member.

4. Footwear in accordance with claim 3 wherein said at least one side of said sole member is the lateral side.

5. Footwear in accordance with claim 4 wherein said predetermined area is located in the heel area of the footwear.

6. Footwear in accordance with claim 3 wherein said at least one side of said sole member includes both the lateral and medial sides.

7. Footwear in accordance with claim 6 wherein said predetermined area is located in the heel area of the footwear.

8. Footwear in accordance with claim 4 wherein said predetermined area is located in the forefoot area of the footwear.

9. Footwear in accordance with claim 6 wherein said predetermined area is located in the forefoot area of the footwear.

10. Footwear in accordance with claim 5 wherein said predetermined area is further located in the forefoot area of the footwear.

11. Footwear in accordance with claim 7 wherein said predetermined area is further located in the forefoot area of the footwear.

12. Footwear in accordance with claim 1 or 2 wherein the flexible material of said inner member forms a plurality of chambers in said insert so that the upper and lower surfaces of said insert define peaks and valleys.

13. Footwear in accordance with claim 12 wherein said elastomeric yieldable outer member fills the space in the valleys along at least one of the upper and lower surfaces of said insert.

14. Footwear in accordance with claim 12 wherein said elastomeric yieldable outer member fills the space in the valleys along both the upper and lower surfaces of said insert.

15. Footwear in accordance with claim 1 or 2 wherein said gaseous medium comprises an inert, non-polar, large molecule gas having a low solubility coefficient, said flexible material having characteristics of relative low permeability with respect to said gas to resist diffusion of said gas therethrough from said insert and of relatively high permeability with respect to the ambient air surrounding said insert to permit diffusion of said ambient air through said flexible material into said inflated insert to provide a total pressure in said insert which is the sum of the partial pressure of the gas in said insert and the partial pressure of the air in said insert, the diffusion rate of said gas through said flexible material being substantially lower than the diffusion rate of nitrogen through said flexible material.

16. Footwear in accordance with claim 15 wherein said outer member is a yieldable foam.

17. Footwear in accordance with claim 1 or 2 wherein said outer member is a yieldable foam.

18. Footwear comprising an upper, a sole member attached to said upper, said sole member including a sealed inner member of flexible material, said inner member being inflated with a gaseous medium to form a compliant and resilient insert having spaced upper, lower, front, back and side surfaces, an outer member formed of an elastomeric yieldable foam encapsulating said insert about preselected portions of said insert, said preselected portions including a major portion of at least said upper or lower surface and a portion of said side surfaces, said inner and outer members functioning together to form a viscoelastic unit for attenuating shock and returning energy of foot impact, and means for adjusting the impact response of said viscoelastic unit to have the effect of said insert dominate the impact response function of said unit in a predetermined area adjacent at least one side of said insert and adjacent an outer edge of at least one side of said sole member, said adjusting means including a gap formed in said outer member along the side of said insert adjacent said predetermined area, said gap extending from a surface of said insert to said outer edge of said at least one side of said sole member to form an open space where the flexible material of said sealed inner member can flex during foot impact, said predetermined area having a forward end spaced rearward of the front surface of said insert and a rearward end spaced forward of the back surface of said insert whereby said impact response adjustment to said viscoelastic unit is substantially localized between the forward and rearward ends of said predetermined area.

19. Footwear in accordance with claim 18 wherein said gaseous medium comprises an inert, non-polar, large molecule gas having a low solubility coefficient, said flexible material having characteristics of relative low permeability with respect to said gas to resist diffusion of said gas therethrough from said insert and of relatively high permeability with respect to the ambient air surrounding said insert to permit diffusion of said ambient air through said flexible material into said inflated insert to provide a total pressure in said insert which is the sum of the partial pressure of the gas in said insert and the partial pressure of the air in said insert, the diffusion rate of said gas through said flexible material being substantially lower than the diffusion rate of nitrogen through said flexible material.

20. Footwear in accordance with claim 18 or 19 wherein said predetermined area is located in the heel area of the footwear.

21. Footwear in accordance with claim 18 or 19 wherein said predetermined area is located in the forefoot area of the footwear.

22. Footwear in accordance with claim 20 wherein said predetermined area is further located in the forefoot area of the footwear.

23. Footwear comprising an upper, a sole member attached to said upper, said sole member including a sealed inner member of flexible material, said inner member being inflated with a gaseous medium to form a compliant and resilient insert having spaced upper, lower, front, back and side surfaces and forming a plurality of chambers such that the upper and lower surfaces of the insert define peaks and valleys, an elastomeric yieldable outer member encapsulating said insert about preselected portions of said insert, said preselected portions including major portions of at least said upper or lower surfaces and a portion of said side surfaces, said gaseous medium comprising an inert, nonpolar, large molecule gas having a low solubility coefficient, said flexible material having characteristics of low permeability with respect to said gas to resist diffusion of said gas therethrough from said chambers and of relatively high permeability with respect to the ambient air surrounding said chambers to permit diffusion of said ambient air through said flexible material into said inflated chambers to provide a total pressure in said chambers which is the sum of the partial pressure of the gas in said chambers and the partial pressure of the air in said chambers, the diffusion rate of said gas through said flexible material being substantially lower than the diffusion rate of nitrogen through said flexible material, said inner and outer members functioning together to form a viscoelastic unit for attenuating shock and returning energy of foot impact, and means for adjusting the impact response of said viscoelastic unit to have the effect of said insert dominate the impact response function of said unit in a predetermined area adjacent at least one side of said insert, said adjusting means including a gap in said outer member along the side of said insert adjacent said predetermined area, said gap extending from a surface of said insert to form an open space where the flexible material of said sealed inner member can flex during foot impact, said predetermined area having a forward end spaced rearward of the front surface of said insert and a rearward end spaced forward of the back surface of said insert whereby said impact response adjustment to said viscoelastic unit is substantially localized between the forward and rearward ends of said predetermined area.

24. Footwear in accordance with claim 23 wherein said predetermined area is located adjacent an outer edge of at least one side of said sole member and said gap extends to said outer edge of said at least one side of said sole member.

25. Footwear in accordance with claim 24 wherein said at least one side of said sole member includes both said medial and lateral sides.

26. Footwear in accordance with claim 23, 24 or 25 wherein said preselected portions of said insert include major portions of both said upper and lower surfaces.

* * * * *